US012778266B2

(12) United States Patent
Joung

(10) Patent No.: US 12,778,266 B2
(45) Date of Patent: Nov. 3, 2026

(54) ROTATIONAL ANGLE-ADJUSTABLE STICK COSMETIC CONTAINER

(71) Applicant: Jae Yong Joung, Anyang-si (KR)

(72) Inventor: Jae Yong Joung, Anyang-si (KR)

( * ) Notice: Subject to any disclaimer, the term of this patent is extended or adjusted under 35 U.S.C. 154(b) by 44 days.

(21) Appl. No.: 19/116,711

(22) PCT Filed: Sep. 19, 2023

(86) PCT No.: PCT/KR2023/014119
§ 371 (c)(1),
(2) Date: Mar. 28, 2025

(87) PCT Pub. No.: WO2024/071798
PCT Pub. Date: Apr. 4, 2024

(65) Prior Publication Data

US 2026/0114587 A1 Apr. 30, 2026

(30) Foreign Application Priority Data

Sep. 29, 2022 (KR) ..... 10-2022-0124131

(51) Int. Cl.
*A45D 40/06* (2006.01)
*A45D 40/00* (2006.01)
*A45D 40/04* (2006.01)

(52) U.S. Cl.
CPC ..... *A45D 40/06* (2013.01); *A45D 2040/0006* (2013.01); *A45D 40/04* (2013.01)

(58) Field of Classification Search
CPC ..... A45D 40/06; A45D 2040/0006; A45D 40/00; A45D 40/04; A45D 40/02; A45D 40/10; A45D 2040/105; A45D 40/12; A45D 2040/208; B65D 83/0011; B65D 83/761
USPC ..... 401/68, 69, 74, 75, 76, 81, 84, 87, 172, 401/174
See application file for complete search history.

(56) References Cited

U.S. PATENT DOCUMENTS 6,592,278 B1 * 7/2003 Holthaus ..... A45D 40/04 401/175
2007/0025799 A1 * 2/2007 Crosnier ..... A45D 40/04 401/75

FOREIGN PATENT DOCUMENTS

KR 10-1666012 B1 10/2016
KR 10-1965291 B1 4/2019
KR 10-2085936 B1 3/2020
KR 10-2022-0069500 A 5/2020
KR 10-2020-0089076 A 7/2020

* cited by examiner

*Primary Examiner* — David J Walczak
(74) *Attorney, Agent, or Firm* — Heedong Chae; Lucem, PC

(57) ABSTRACT

A rotational angle-adjustable stick cosmetic container according to an embodiment of the present invention comprises: a body; an operating member which is coupled inside the body and has a lift protrusion formed therein; a protective tube which is rotatably coupled to the body; a stick holder which is moved up and down within the protective tube, has a stick cosmetic product at one side thereof, and has a lifting thread formed thereon; a rotating member which is coupled to the body or protective tube and rotated therewith about an axis; and an elastic member which provides the rotating member with elasticity and includes a fastening portion coupled to the rotating member and an elastic portion elastically deformed while being pushed by the rotating member.

5 Claims, 9 Drawing Sheets

ROTATIONAL ANGLE-ADJUSTABLE STICK COSMETIC CONTAINER

TECHNICAL FIELD

One aspect of the present disclosure relates to a stick-type cosmetic container, and more particularly, to a stick-type cosmetic container for constantly adjusting a rotational angle between a body and a protective tube relative to each other to uniformly maintain an ascending or descending length of a stick-type cosmetic content.

BACKGROUND ART

In general, women use various cosmetics to make up their appearances more beautiful. Among the cosmetics, color cosmetics are used for the purpose of making the skin beautiful by changing the appearance beautifully.

The color cosmetics are divided into base makeup cosmetics used for achieving even skin tones and concealing imperfections, and point makeup cosmetics for partially enhancing the three-dimensional feeling such as lips, eyes and nails. The base makeup includes a makeup base, a foundation, a powder, and so on, and the point makeup includes a lipstick, an eye liner, and a mascara.

The foundation refers to a cosmetic product used to naturally cover spots or blemishes on the skin exposed to the outside, such as the face, or to express clean and bright skin or clear and soft skin. When used for makeup, the foundation is spread evenly on the skin without clumping by using a cosmetic puff.

The foundation is usually stored in a wide and flat compact container, and the puff is accommodated inside the compact container together.

However, in order to use the foundation accommodated in the compact container, a user opens a lid of the container, holds the puff accommodated on an upper part of a lid of an inner container, opens the lid of the inner container, dips foundation cosmetic contents using the puff and then applies the contents onto the skin, resulting in inconvenience for use, and a hand of the user gets dirty because the foundation cosmetic contents remaining on the puff are put on the hand during the above process.

Accordingly, for the convenience in use and the convenience in portable storage, a stick-type cosmetic container has been developed in which a stick-type cosmetic is mounted on one side of a container, and the stick-type cosmetic mounted inside the container is used by raising and lowering the stick-type cosmetic content according to rotation of the container.

Korean Utility Model Registration No. 20-0393382 discloses 'a stick type cosmetic container' as a conventional stick-type cosmetic container having the above structure. The above related art have a structure including a housing, a lower cap coupled to a lower part of the housing and having a screw-shaped lifting guide hole formed therein, an operating member ascending and descending according to the rotation of the lower cap, a storage member ascending and descending together with the operating member and having a stick-shaped cosmetic content attached thereto, a protective tube for supporting the ascending and descending of the storage member and storing the stick-shaped cosmetic content, and an upper cap for sealing the protective tube, wherein the housing is rotated while the protective tube being gripped, so that the stick-shaped cosmetic content is drawn out from or inserted to the protective tube.

However, according to the above related art, it is inconvenient because an ascending or descending length of the stick cosmetic content due to the rotation operation of the housing becomes irregular each time, and the housing is required to be finely rotated to draw in and out the stick cosmetic content by a certain length. In addition, the housing may be rotated due to the user's carelessness during makeup, and accordingly the stick cosmetic content is drawn out of the protective tube or inserted into the protective tube, thereby lowering the convenience in use.

In order to solve the above-mentioned problems, Korean Patent Registration No. 10-1594253 discloses a cosmetic tool. The above related art has a structure in which a protrusion insertion portion is formed in a snap ring of a body and a snap protrusion is formed on an outer circumference of a rotating portion, so that the snap protrusion of the rotating portion forcibly passes through an inner circumferential surface of the snap ring and inserted into the protrusion insertion portion of the snap ring to limit the rotation of the rotating portion.

However, according to the above related art, the rotating portion is required be strongly rotated to force the snap protrusion of the rotating portion to pass through the inner circumferential surface of the snap ring, and accordingly, it is difficult for women having relatively weak strength to rotate the rotating portion, thereby causing difficulty in use.

In addition, according to the above related art, the snap protrusion of the rotating portion wears out due to friction with the inner circumferential surface of the snap ring when used for a long period of time, and accordingly, the rotating portion may fail to perform the rotation limiting function through the snap ring.

DOCUMENT OF RELATED ART

Patent Document (Patent Document 001) Korean Utility Model Registration No. 20-0393382 (Published on Aug. 18, 2005)

(Patent Document 002) Korean Patent Registration No. 10-1594253 (Published on Feb. 17, 2016)

DISCLOSURE

Technical Problem

In order to solve the above conventional problems, an object of the present disclosure is to provide a rotational angle-adjustable stick cosmetic container in which a body and a protective tube are rotatably coupled to each other, and the rotation of the protective tube relative to the body is flexibly limited at every predetermined angle, thereby constantly adjusting the rotation angle of the protective tube, so that an ascending or descending length of a stick-type cosmetic content is always maintained uniformly.

Technical Solution

In order to achieve the above-mentioned object, one aspect of the present disclosure provides a rotational angle-adjustable stick cosmetic container including: a body; an operating member coupled inside the body and having a lift protrusion formed therein; a protective tube rotatably coupled to the body; a stick holder moved up and down within the protective tube, having a stick cosmetic content at one side thereof, and having a lifting thread formed thereon; a rotating member coupled to the body or the protective tube and rotated therewith about an axis; and an elastic member configured to provide the rotating member with elasticity, and including a fastening portion coupled to the rotating member, and an elastic portion elastically deformed while being pushed by the rotating member.

In addition, the rotating member may include a fastening groove to which the fastening portion of the elastic member is inserted and fitted, and a cut surface coming into close contact with one side of the elastic member to limit rotation of the rotating member.

In addition, the fastening portion of the elastic member may be fitted horizontally while wrapping around an outer circumference of the rotating member, and the elastic portion may be elastically deformed while coming into close contact with an inner wall of the body.

In addition, the elastic portion of the elastic member may include an elastic wall coming into contact with an outer circumference of the rotating member, a guide rib extending from the elastic wall and fitted and coupled to the body, and an elastic rib for elastically supporting the elastic wall.

In addition, the elastic members may be provided as a pair and arranged symmetrically on both sides of the rotating member as a center.

Advantageous Effects

According to the embodiment of the present disclosure, the rotation angle of the protective tube relative to the body is constantly adjusted, so as to ensure that the ascending or descending length of stick-type cosmetic content is always maintained uniformly, so that convenience in use can be implemented.

According to the embodiment of the present disclosure, through the interlocking action of the rotating member axis-rotated along with the body or the protective tube and the elastic member coupled to the rotating member, the rotation angle between the body and the protective tube can be easily adjusted with a relatively little force.

According to the embodiment of the present disclosure, the elastic member is elastically deformed to provide elasticity to the side of the rotating member, so that the rotation angle adjustment function can be performed smoothly even after long-term use.

BEST MODE

Mode for Invention

Figure 1:
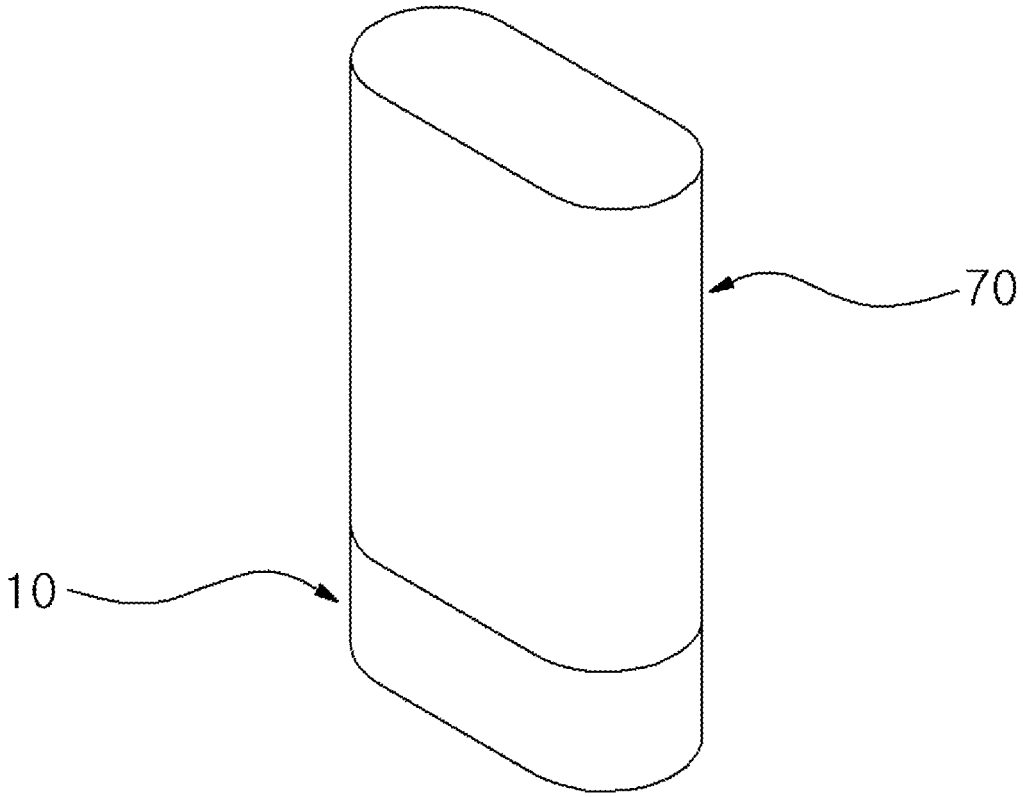
FIG. 1 is a perspective view of a stick-type cosmetic container according to one embodiment of the present disclosure.

Hereinafter, the detailed descriptions of the present disclosure are embodiments for carrying out the present disclosure, and the corresponding embodiment refers to the accompanying drawings as an example. The embodiments will be described in detail to enable those skilled in the art to carry out the present disclosure. It is apparent to be understood that the various embodiments of the present disclosure may be different from each other but do not need to be mutually exclusive. For example, the particular shapes, structures, and features described herein may be embodied in other embodiments without departing from the idea and scope of the present disclosure in connection with an embodiment. In addition, it will be understood that the location or arrangement of an individual element within each disclosed embodiment may be modified without departing from the idea and scope of the present disclosure.

Accordingly, the detailed description set forth below is not intended to be taken in a limiting sense, and the scope of the present disclosure is limited only by the appended claims, along with the full scope of equivalents to which the claims are entitled, if properly described. Similar reference numerals in the drawings refer to the same or similar function throughout several aspects.

General term which is widely used recently has been selected in the present disclosure in consideration of the function according to the present disclosure as possible, but this may vary depending on the intention of those skilled in the art, precedents, the emergence of new technology or the like. In addition, in a specific case, the term may be arbitrarily selected by the applicant, and in this case, the meaning thereof will be described in detail in the corresponding description of the invention. Therefore, the term used in the present disclosure will be defined based on the meaning of the term and contents throughout the present disclosure, not simply on the name of the term.

In the present disclosure, when one component "includes" some elements, it does not exclude other elements, but may further include the other elements, unless particularly stated otherwise.

Hereinafter, a rotational angle-adjustable stick cosmetic container according to the embodiments of the present disclosure will be described in detail with reference to the accompanying drawings.

Figure 2:
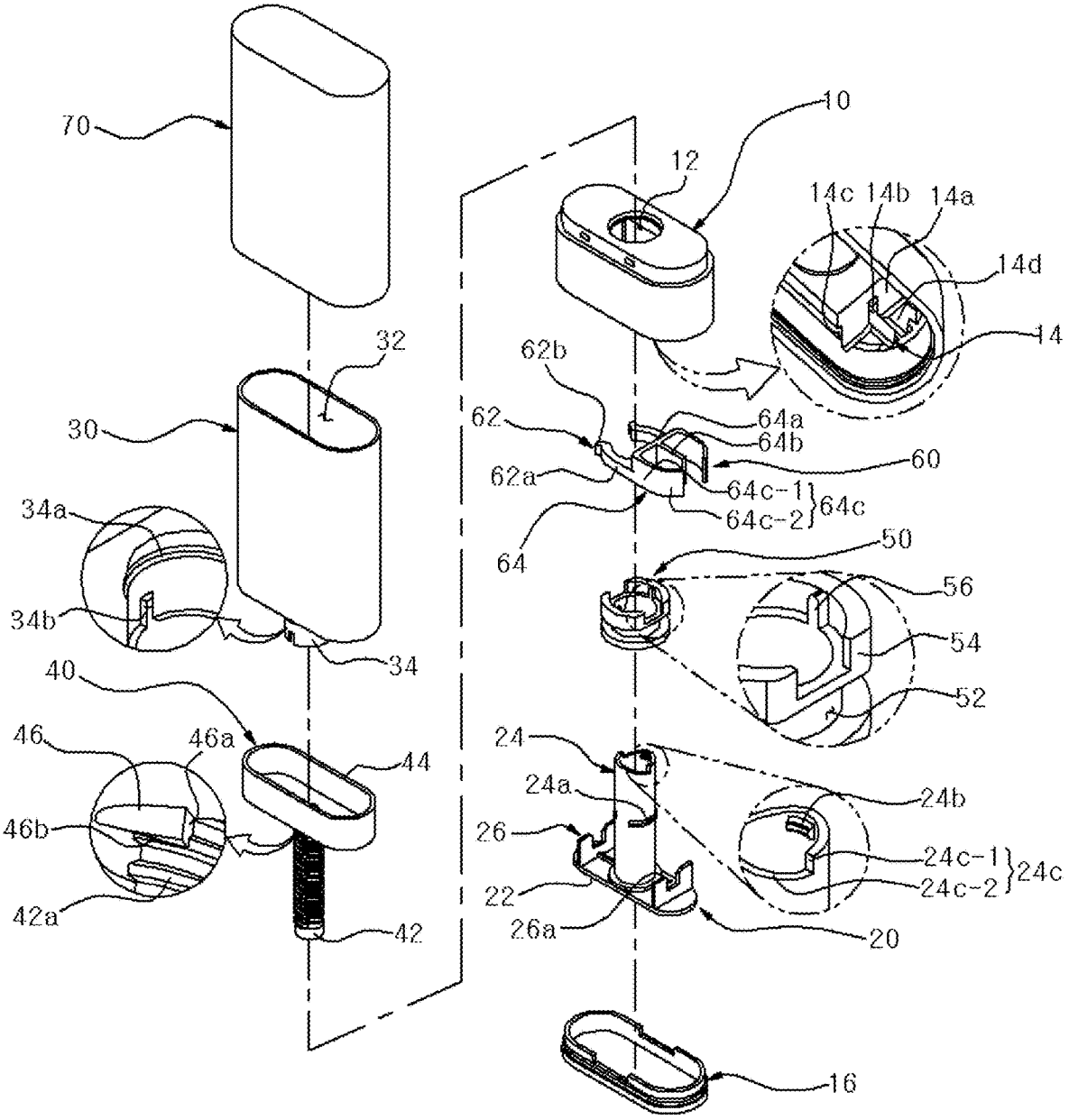
FIG. 2 is an exploded perspective view of the stick-type cosmetic container according to one embodiment of the present disclosure.
Figure 3:
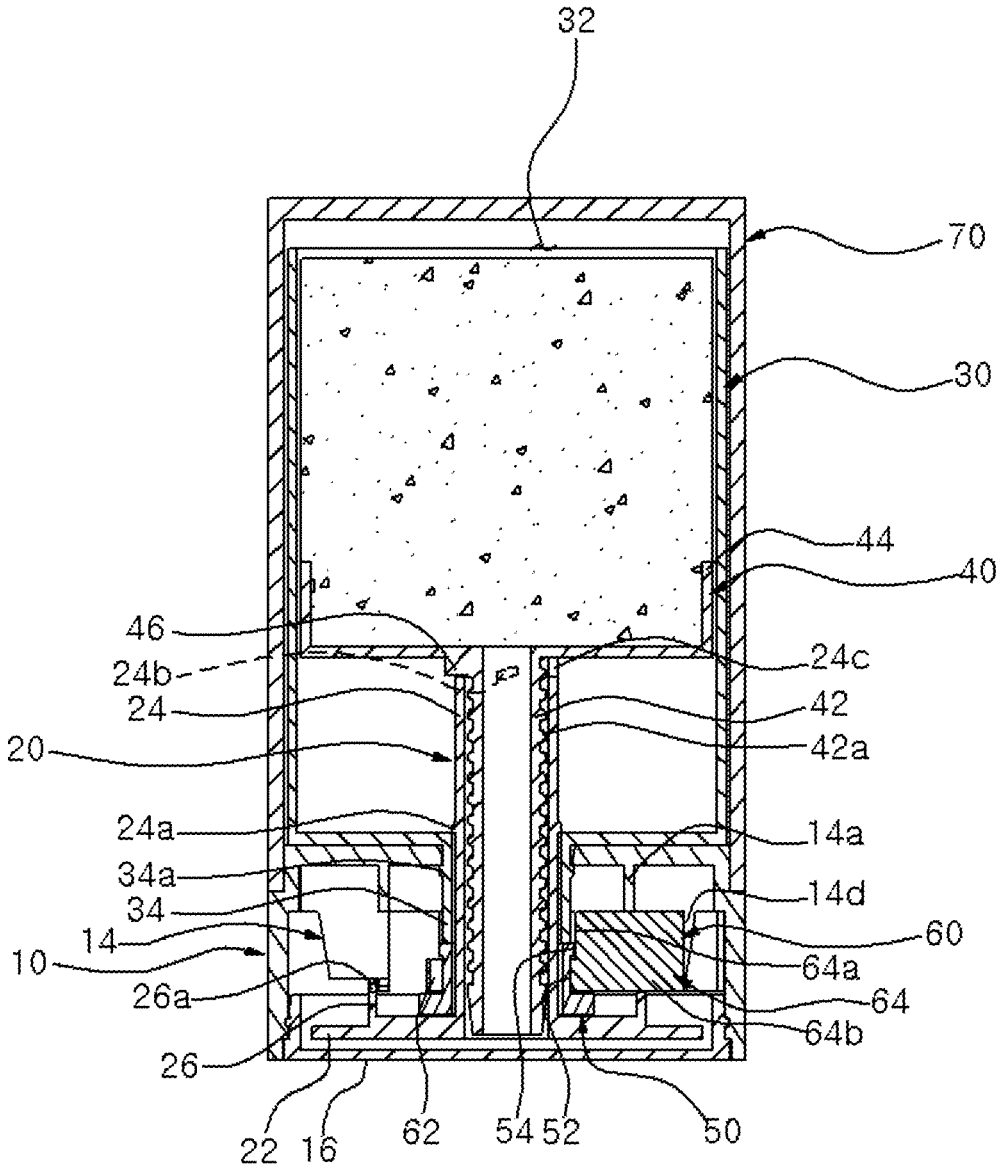
FIG. 3 is a sectional view of the stick-type cosmetic container according to one embodiment of the present disclosure.

FIG. 1 is a perspective view of a stick-type cosmetic container according to one embodiment of the present disclosure, FIG. 2 is an exploded perspective view of the stick-type cosmetic container according to one embodiment of the present disclosure, and FIG. 3 is a sectional view of the stick-type cosmetic container according to one embodiment of the present disclosure.

As shown in the drawing, a rotational angle-adjustable stick cosmetic container according to the embodiments of the present disclosure may be configured to include a body 10, an operating member 20, a protective tube 30, a stick holder 40, a rotating member 50, and an elastic member 60.

The rotational angle-adjustable stick cosmetic container according to the embodiments of the present disclosure will be described separately for each component as follows.

The body 10 refers to a part held by a user during makeup, and is formed in a three-dimensional shape having a certain space therein. The drawings of the stick-type cosmetic container according to one embodiment of the present disclosure show the body 10 as an oval formed of a pair of planes parallel to each other and a curved surface connecting ends of the pair of planes to each other.

However, the present disclosure is not limited thereto, and may be formed of various shapes or materials, taking into account factors such as usability or design.

As shown in FIG. 2, a through-hole 12 is formed on one side of the body 10, in which the through-hole 12 may formed in a center of a surface coming into contact with the protective tube 30, and the operating member 20 and at least a part of the protective tube) may pass therethrough.

A guide portion 14 may be formed on an inside of the body 10 to allow the elastic member 60 to be fitted therein, and the guide portion 14 and the elastic member 60 may be mounted together on the operating member 20. The guide portion 14 may be provided on both sides around the through-hole 12 as a center, and may rotate the operating member 20 together with the body 10 and simultaneously guide a linear movement direction of the elastic member 60 while preventing the elastic member 60 from being separated.

The guide portion 14 may include a guide plate 14*a* extending downward from an inner upper surface of the body 10, first and second insertion grooves 14*b* and 14*c* formed in the guide plate 14*a* into which at least a part of the elastic member 60 is inserted, and a guide bar 14*d* connected perpendicularly to the guide plate 14*a* to extend along a reciprocating movement direction of the elastic member 60. The first insertion groove 14*b* may be formed in a center of the guide plate 14*a*, the second insertion groove 14*c* may be formed between both sides of the guide plate 14*a* and an inner wall of the body 10, and the guide bars 14*d* may be symmetrically formed as a pair on both sides about the first insertion groove 14*b* as a center.

In addition, a lower cap 16 is formed on one open side of the body 10, and the lower cap 16 is fixedly coupled while covering a bottom part of the body 10.

Meanwhile, an overcap 70 may be detachably coupled to one side of the body 10. The overcap 70 is coupled to or separated from the body 10 so that the protective tube 30 and the stick-shaped cosmetic content contained therein are protected or exposed to the outside. The drawings of the stick-type cosmetic container according to one embodiment of the present disclosure show that protrusions are formed on each of the body 10 and the overcap 70 so as to be coupled to each other by undercuts. However, the present disclosure is not limited thereto, and various coupling structures, such as protrusion and groove coupling, forced fitting coupling and screw coupling, may be implemented within the range for allowing the overcap 70 to be easily attached to and detached from the body 10.

The operating member 20 is fixedly coupled to the inside of the body 10 and screw-coupled to the stick holder 40 to raise and lower the stick holder 40.

The operating member 20 may include a bottom plate 22, an operating portion 24 extending from a center of the bottom plate 22, and mounting portions 26 arranged on both sides about the operating portion 24 and extending from the bottom plate 22. The bottom plate 22 is formed to have an edge corresponding to the inner wall of the body 10 and inserted into an inner space of the lower cap 16.

The operating portion 24 of the operating member 20 may have a cylindrical shape with an empty interior, and pass through the through-hole 12 of the body 10 so as to be at least partially inserted into the inner space of the protective tube 30, and the stick holder 40 may be inserted into and screw-coupled to the operating portion. The operating portion 24 has an outer circumference from which a first locking protrusion 24*a* protrudes to be rotatably locked and coupled with the protective tube 30, and has an inner circumference from which a lifting protrusion 24*b* is formed to be screw-coupled to a lifting thread 44 of the stick holder 40. It may be preferable that the operating portion 24 has a cylindrical shape with a hollow center, and the first locking protrusion 24*a* extends along a predetermined section of the outer circumference of the operating portion 24.

Meanwhile, a one-way rotation protrusion 24*c* may be formed at an end of the operating portion 24 of the operating member 20 and engaged with a one-way rotation protruding portion 46 formed on the stick holder 40, and accordingly, the operating member 20 and the stick holder 40 may be rotated in only one direction relative to each other. The one-way rotation protrusion 24*c* may include a locking surface 24*c*-1 extending vertically from the end of the operating portion 24, and a diagonal surface 24*c*-2 inclined at a predetermined angle from the locking surface 24*c*-1. It may be preferable that the locking surface 24*c*-1 and the diagonal surface 24*c*-2 are arranged alternately and continuously along the circumferential end of the operating portion 24.

The mounting portion 26 of the operating member 20 refers to a plate having a predetermined area, and may be formed at an upper center thereof with a mounting groove 26*a* into which the guide portion 14 of the body 10 and a guide rib 64*b* of the elastic member 60 are inserted. It may be preferable that the mounting portion 26 are provided as a pair and positioned opposite to each other about the operating portion 24 as a center, and each mounting portion 26 is formed across one side of the bottom plate 22.

The protective tube 30 is rotatably coupled to the body 10, and wraps and protects the stick holder 40 and the stick-type cosmetic content attached to the stick holder 40. It may be preferable that the protective tube 30 has the same diameter and surface shape as the end of the body 10 for continuity of the design.

As shown in FIG. 3, the protective tube 30 may be formed at one side thereof with an inlet portion 32, and the stick-type cosmetic content may be drawn to the outside or introduced into the protective tube 30 through the inlet portion 32.

The insertion protruding portion 34 may extend from an opposite side of the inlet portion 32 of the protective tube 30. The insertion protruding portion 34 passes through the through-hole 12 of the body 10, and is at least partially inserted into an inner space of the rotating member 50. The insertion protruding portion 34 has a second locking protrusion 34*a* protruding on an outer circumference thereof, and has a fitting groove 34*b* formed on an end thereof, in which the second locking protrusion 34*a* is locked and coupled to an outer wall of the through-hole 12 of the body 10 to prevent the protective tube 30 from being separated from the body 10 together with the first locking protrusion 24*a*, and the fitting groove 34*b* is fitted and coupled to the rotating member 50 so that the rotating member 50 is rotated together with the protective tube 30.

The stick holder 40 has at least a portion screw-coupled to the operating member 20 while being positioned inside the protective tube 30, and ascends and descends along the protective tube 30 when the protective tube 30 is rotated relative to the body 10, thereby allowing the stick-type cosmetic content to be drawn to the outside or inserted into the body 10.

The stick holder 40 may include a coupling portion 42 screw-coupled to the operating member 20 and a plate portion 44 to which the stick-type cosmetic content is attached.

The coupling portion 42 is formed on one side of the stick holder 40 and inserted into the operating portion 24 of the operating member 20. A lifting thread 42*a* is formed on an outer circumference of the coupling portion 42, in which the lifting thread 42*a* is screw-coupled to the lifting protrusion 24*b* of the operating member 20 to guide a linear movement of the stick holder 40. In other words, when the protective tube 30 is rotated relative to the body 10, the stick holder 40 positioned inside the protective tube 30 is rotated together, and accordingly, the lifting thread 42*a* of the stick holder 40 moves along the lifting protrusion 24*b* of member 20, and the operating simultaneously the stick holder 40 ascends and descends in the protective tube 20. It may be preferable that the lifting thread 42*a* is inclined at an appropriate angle along the outer circumference of the stick holder 40 in consideration of smooth operation, moving distance and the like of the stick holder 40. For example, when the inclination angle of the lifting thread 42*a* is relatively large, the moving distance of the stick holder 40 may increase upon rotation of the protective tube 30 at a predetermined angle relative to the body 10, and thus a lifting speed of the stick-type cosmetic content may become faster. In contrast, when the inclination angle of the lifting thread 42*a* is relatively small, the moving distance of the stick holder 40 may decrease upon rotation of the protective tube 30 at a predetermined angle relative to the body 10, and thus the lifting speed of the stick-type cosmetic content may become slower.

The plate portion 44 is formed on one end of the coupling portion 42, has an outer wall formed along an edge thereof to have a predetermined height, and the stick-type cosmetic content may be inserted and filled therein.

Meanwhile, the one-way rotation protruding portion 46 is formed between the coupling portion 42 and the plate portion 44 of the stick holder 40 and engaged with the one-way rotation protrusion 24*c* of the operating member 20, and accordingly, the operating member 20 and the stick holder 40 may be rotated in only one direction relative to each other. The one-way rotation protruding portion 46 may include a locking section 46*a* extending vertically from a lower surface of the plate portion 44, and an inclining section 46*b* inclined at a predetermined angle from the locking section 46*a*. It may be preferable that the locking section 46*a* and the inclining section 46*b* are arranged alternately and continuously along the outer circumference of the coupling portion 44.

The rotating member 50 is coupled to the body 10 or the protective tube 30 and rotated together on an axis, thereby constantly adjusting a rotation angle of the body 10 and the protective tube 30 relative to each other. The rotating member 50 may be formed in a ring shape, and rotated together with the protective tube 30 while being fitted around an outer side of the operating portion 24 of the operating member 20. For the stick-type cosmetic container according to one embodiment of the present disclosure, the rotating member 50 is taken as an example to be coupled to the protective tube 30 within the body 10 and rotated about the axis with respect to the body 10 together with the protective tube 30. However, the present disclosure is not limited thereto, and it may be coupled to the body 10 and rotated about the axis with respect to the protective tube 30 together with the body 10. In this case, it may be preferable that the rotating member 50 and the elastic member 60, which provides elasticity to the rotating member 50, are positioned inside the protective tube 30 and operated closely together.

As shown in FIG. 2, the rotating member 50 may be formed therein with a fastening groove 52 to which a fastening portion 62 of the elastic member 60 is inserted and fitted. It may be preferable that the fastening groove 52 extend to have a width and a depth that are constant as a whole along the outer circumference of the rotating member 50.

In addition, the rotating member 50 may be formed therein with a cut surface 54 coming into close contact with one side of the elastic portion 64 of the elastic member 60. The cut surface 54 refers to a part that constantly limits the rotation angle of the rotating member 50, and it may be preferable that the cut surface is formed as a flat surface on an outer surface of the curved rotating member 50, and formed as a pair to face each other. The number of the cut surfaces 54 may be modified to appropriately adjust the rotation angle of the rotating member 50. For example, when the cut surface 54 is formed as two sections facing each other, the rotation of the rotating member 50 is limited every 180 degrees. When formed in three sections, the rotation of the rotating member 50 is limited every 120 degrees. When formed in four sections, the rotation of the rotating member 50 is limited every 90 degrees. In the above manner, when the rotation angle of the rotating member 50 is changed, the lifting height of the stick holder 40 is also adjusted according to the rotation of the rotating member 50.

Meanwhile, a fitting protrusion 56 is formed in the rotating member 50, in which the fitting protrusion 56 protrudes from the inner circumference of the rotating member 50 and is coupled to the fitting groove 34*b* of the protective tube 30, so that the rotating member 50 is rotated together with the protective tube 30. The coupled structure between the protective tube 30 and the rotating member 50 may be formed in opposite directions, that is, the fitting protrusion may be formed on the protective tube 30 and the fitting groove may be formed in the rotating member 50.

Figure 9:
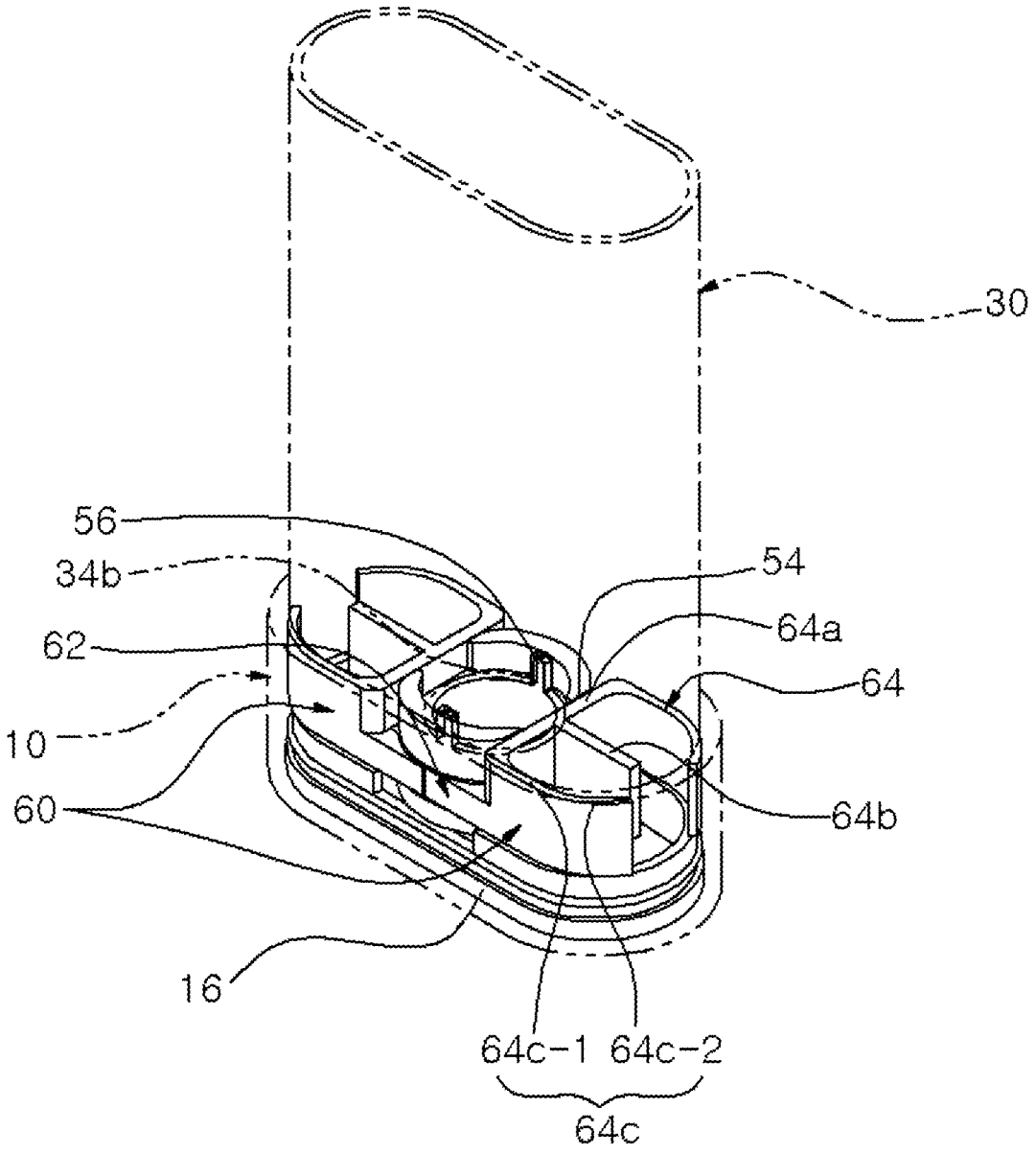
FIG. 9 is a perspective view of a stick-type cosmetic container according to another embodiment of the present disclosure.

FIG. 9 is a perspective view of a stick-type cosmetic container according to another embodiment of the present disclosure.

The elastic member 60 is fitted and coupled to a side of the rotating member 50 and provides elasticity to the rotating member 50, so that the rotation of the rotating member 50 is limited at a predetermined angle.

The elastic member 60 may include a fastening member 62 coupled to the rotating member 50, and an elastic portion 64 elastically deformed while being pushed by the rotating member 50.

The fastening portion 62 may include a pair of fastening ribs 62*a* fitted horizontally to the rotating member 50 while being inserted into the fastening groove 52 of the rotating member 50, and elastically fastened to the rotating member 50 while surrounding the outer circumference of the rotating member 50. The pair of fastening ribs 62*a* elastically spreads out while moving toward the outside of the rotating member 50 when the elastic portion 64 is pushed by the rotating member 50 and elastically deformed. It may be preferable that the fastening ribs 62*a* are formed to have curved inner circumferential surfaces to corresponds to the outer surface of the rotating member 50, and arranged to face each other to be spaced apart from each other at a predetermined distance.

Meanwhile, a bending portion 62*b* may be formed at an end of each of the fastening ribs 62*a*. The bending portion 62*b* is configured to allow the fastening portion 62 to be easily fitted to the side surface of the rotating member 50, and may extend outward from a center of the rotating member 50 and gradually spread out from each other as extending toward the end.

The elastic portion 64 is configured to be elastically deformed by the rotating member 50 while one side is connected to the fastening portion 62 and an opposite side comes into close contact with the inner wall of the body 10, and may include an elastic wall 64*a* coming into contact with the outer circumference of the rotating member 50, a guide rib 64*b* extending from the elastic wall 64*a* and fitted and coupled to the body 10, and an elastic rib 64*c* for elastically supporting the elastic wall 64*a*.

The elastic wall 64*a* may be arranged to extend vertically from the fastening portion 62 to come into contact with the rotating member 50, and formed as a plane corresponding to the cut surface 54 of the rotating member 50. When the rotating member 50 is rotated, the elastic wall 64*a* is pushed and moved toward the inner wall of the body 10 by the curved outer circumference of the rotating member 50, and comes into complete close contact with the cut surface 54 of the rotating member 50 while returning to the initial position by its own restoring force.

The guide rib 64*b* refers to a part for guiding the linear reciprocating movement of the elastic member 60, and may extend from a center of one side of the elastic wall 64*a* in the opposite direction to the fastening portion 62, and form a right angle with respect to the elastic wall 64*a*. In addition, the guide rib 64*b* may be inserted between the first insertion groove 14*b* of the body 10 and the pair of guide bars 14*d*, and may be inserted and mounted in the mounting groove 26*a* of the operating member 20 together with the guide bars 14*d*. It may be preferable that the guide rib 64*b* and guide bars 14*d* extend long in the operating direction of the elastic member 60, that is, from the center of the body 10 toward the inner side wall.

The elastic rib 64*c* is deformed and then elastically restored when one side thereof is pressed by the elastic wall 64*a* while coming into close contact with the inner wall of the body 10, and extends from one edge of the elastic wall 64*a* in the opposite direction to the fastening portion 62 to form a right angle with respect to the elastic wall 64*a*. In addition, the elastic ribs 64*c* may be formed on both sides centered on the guide rib 64*b* and inserted into the second insertion grooves 14*c* of the body 10, respectively. The elastic rib 64*c* may extend to correspond to the inner wall of the body 10 to come into contact with the inner wall of the body 10, and include a straight section 64*c*-1 extending from the elastic wall 64*a* and a curved section 64*c*-2 extending from the straight section 64*c*-1. The straight section 64*c*-1 transmits a pressing force of the elastic wall 64*a* to the curved section 64*c*-2, and the curved section 64*c*-2 is bent toward the center by the transmitted force and then elastically restored, thereby elastically supporting the elastic wall 64*a*.

Meanwhile, as shown in FIG. 9, the elastic members 60 may be provided as a pair and arranged symmetrically on both sides with the rotating member 50 as a center. The elastic member 60 coupled to each side of the rotating member 50, and elastically deformed in both directions and then restored when the rotating member 50 is rotated, so that the rotation of the rotating member 50 may be limited more stably.

As described above, the stick-type cosmetic container according to one embodiment of the present disclosure is configured such that the rotation of the protective tube 30 relative to the body 10 is flexibly limited at every predetermined angle to constantly adjust the rotation angle f the protective tube 30, so as to ensure that the ascending or descending length of stick-type cosmetic content is always maintained uniformly. The rotation angle of the protective tube 30 relative to the body 10 is constantly adjusted, so as to ensure that the ascending or descending length of stick-type cosmetic content is always maintained uniformly, so that the convenience in use can be facilitated. Through the interlocking action of the rotating member 50 axis-rotated along with the body 10 or the protective tube 30 and the elastic member 60 coupled to the rotating member 50, the rotation angle between the body 10 and the protective tube 30 can be easily adjusted with a relatively little force. In addition, the elastic member 60 is elastically deformed to provide elasticity to the side of the rotating member 50, so that the rotation angle adjustment function can be performed smoothly even after long-term use.

FIGS. 4 to 8 are views illustrating the process of using the rotational angle-adjustable stick cosmetic container according to the embodiments of the present disclosure. The process of using the rotational angle-adjustable stick cosmetic container according to the embodiments of the present disclosure will be described with reference to the views.

Figure 4:
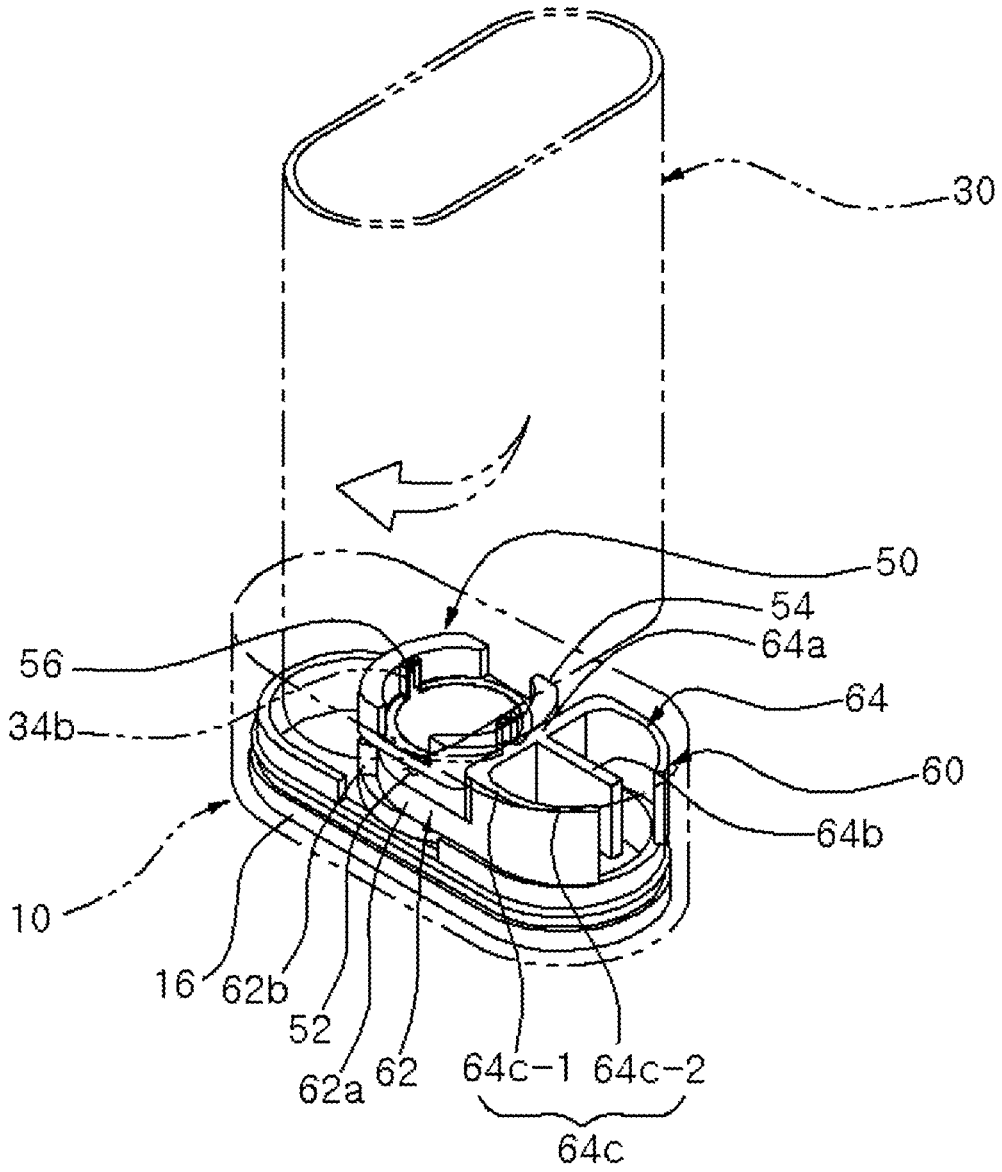
FIG. 4 is a perspective view illustrating a state in which a protective tube is rotated relative to a body according to one embodiment of the present disclosure.
Figure 5:
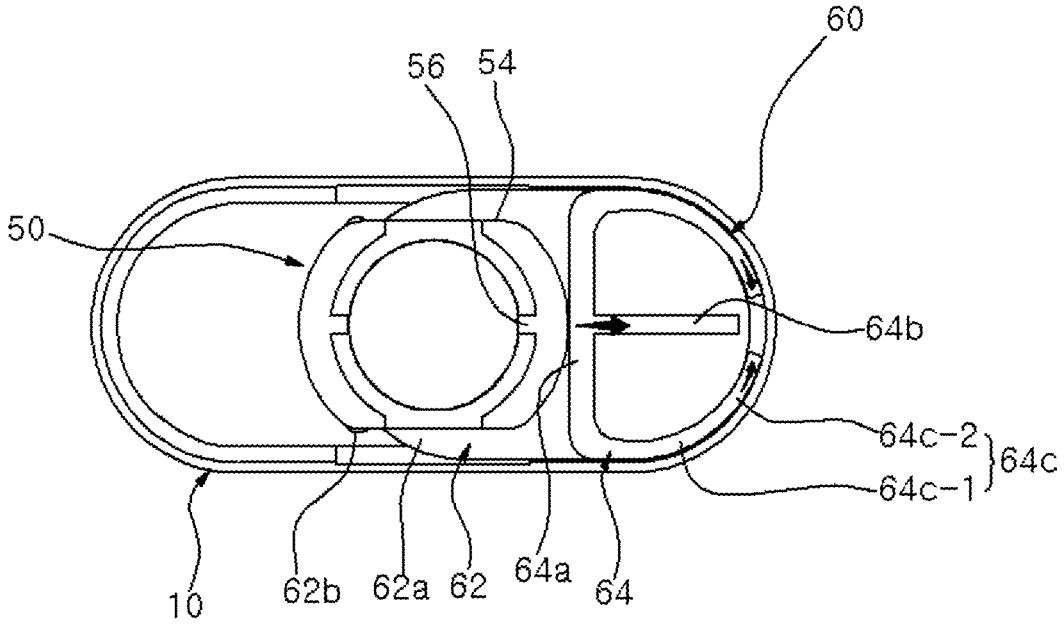
FIG. 5 is a plan view illustrating a state in which the protective tube is rotated relative to the body according to one embodiment of the present disclosure.
Figure 6:
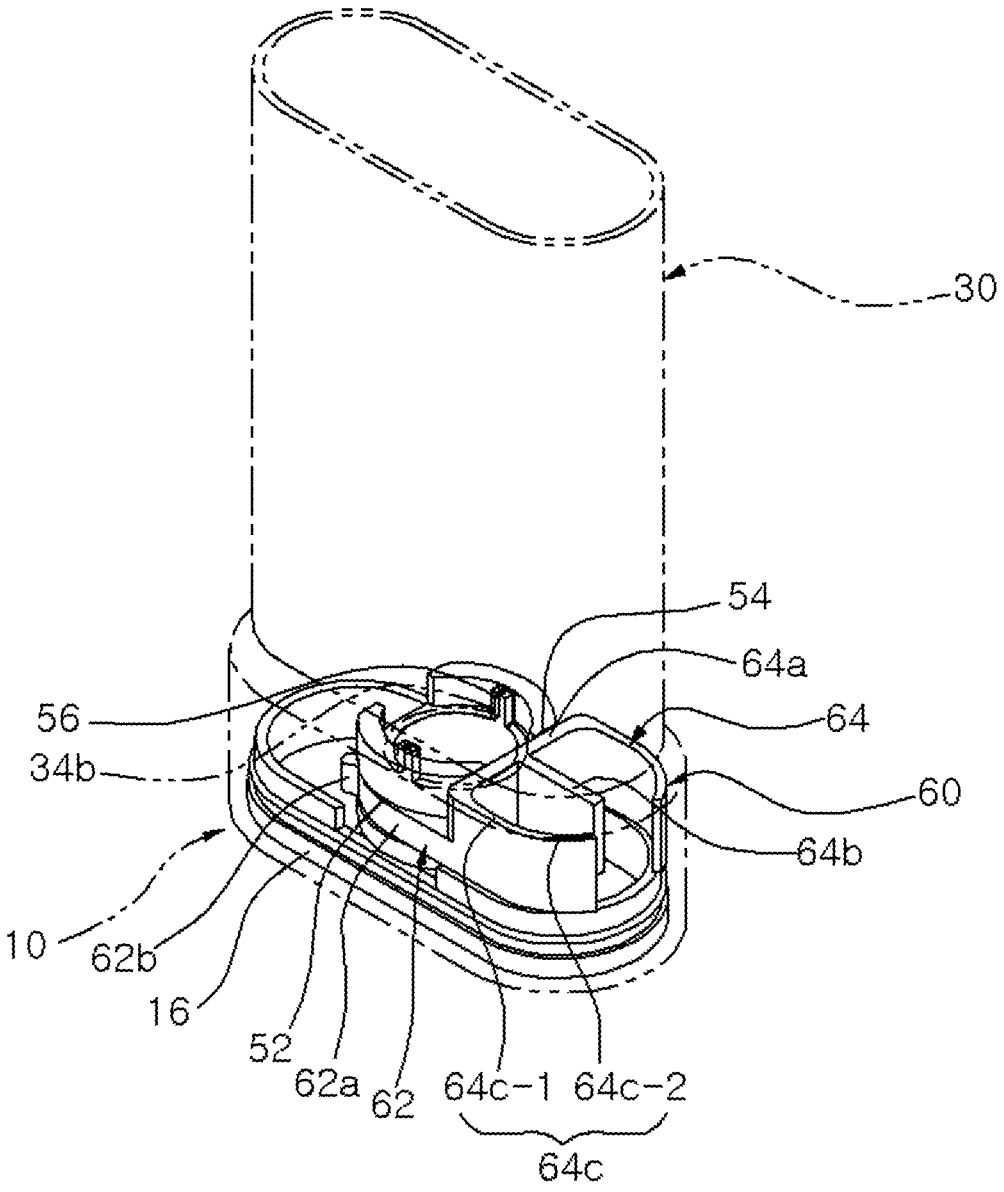
FIG. 6 is a perspective view illustrating a state in which the protective tube is rotated by a certain angle relative to the body according to one embodiment of the present disclosure.
Figure 8:
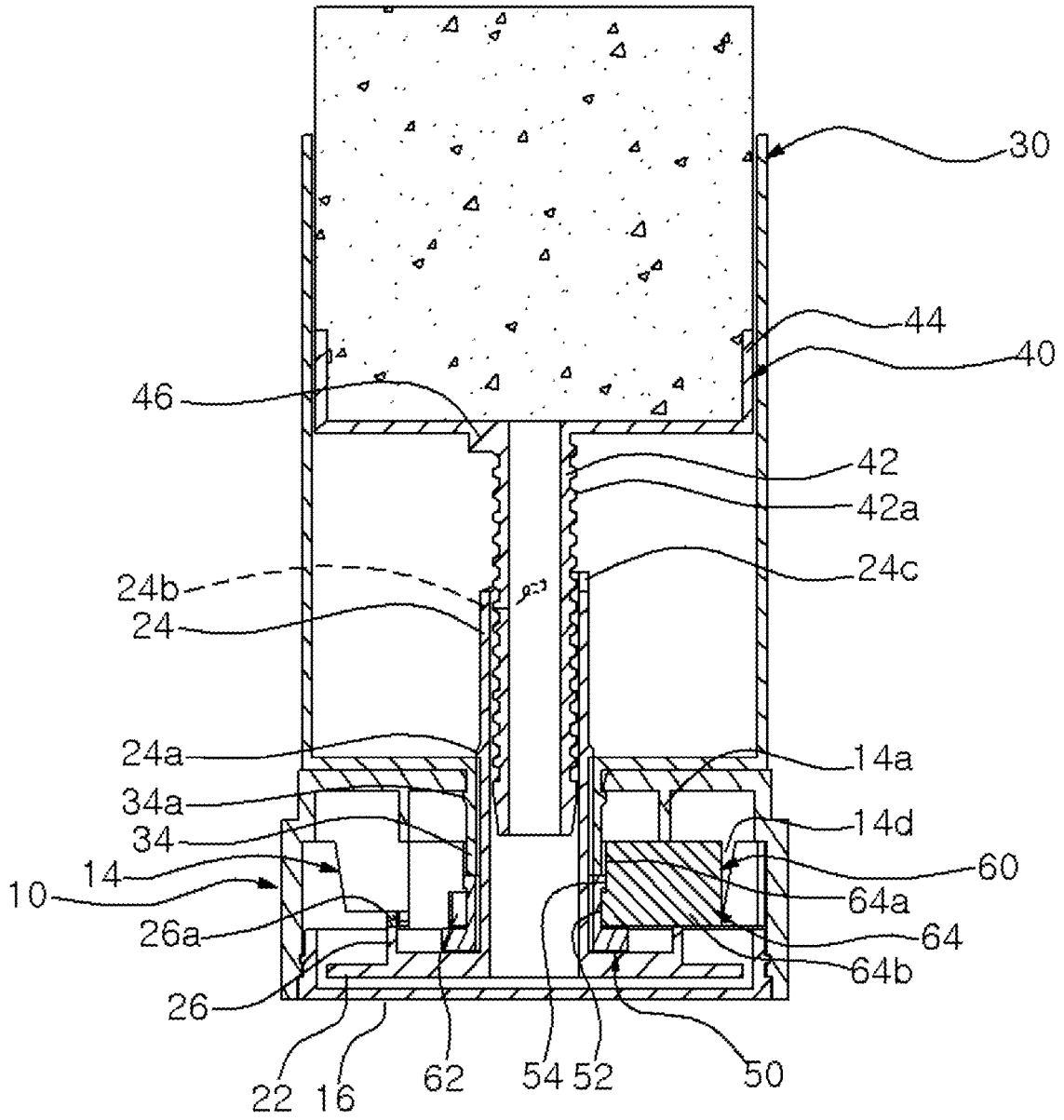
FIG. 8 is a sectional view illustrating a state in which the stick-type cosmetic is drawn out according to one embodiment of the present disclosure.

FIG. 4 is a perspective view illustrating a state in which a protective tube is rotated relative to a body according to one embodiment of the present disclosure, FIG. 5 is a plan view illustrating a state in which the protective tube is rotated relative to the body according to one embodiment of the present disclosure, FIG. 6 is a perspective view illustrating a state in which the protective tube is rotated by a certain angle relative to the body according to one embodiment of the present disclosure, FIG. 6 is a plan view illustrating a state in which the protective tube is rotated by a certain angle relative to the body according to one embodiment of the present disclosure, and FIG. 8 is a sectional view illustrating a state in which the stick-type cosmetic is drawn out according to one embodiment of the present disclosure.

In order to use the rotational angle-adjustable stick cosmetic container according to the embodiments of the present disclosure, the overcap 70 is separated from the body 10 to expose the protective tube 30 to the outside.

Thereafter, as shown in FIG. 4, when the protective tube 30 is rotated relative to the body 10, the stick holder 40 positioned inside the protective tube 30 is rotated together, and accordingly, the stick holder 40 moves up and down while being screw-coupled to the operating member 20. In other words, since the stick holder 40 is rotated by the protective tube 30, but the operating member 20 is fixed within the body 10, the lifting thread 42*a* of the stick holder 40 moves along the lifting protrusion 24*b* of the operating member 20, and accordingly, the stick holder 40 ascends and descends in the protective tube 20.

Simultaneously, when the rotating member 50 is rotated together with the protective tube 30 as shown in FIG. 5, the curved outer circumference of the rotating member 50 pushes the elastic wall 64*a* of the elastic member 60 outward from the center of the rotating member 50, and the elastic rib 64*c* of the elastic member 60 is forcibly pressed while coming into close contact with the inner wall of the body 10, thereby being bent toward the center. The guide rib 64*b* of the elastic member 60 moves between the first insertion groove 14*b* of the body 10 and the pair of guide bars 14*d*, and the elastic rib 64*c* moves within the second insertion groove 14*c* of the body 10, so that the linear reciprocating movement of the elastic member 60 is guided.

Figure 7:
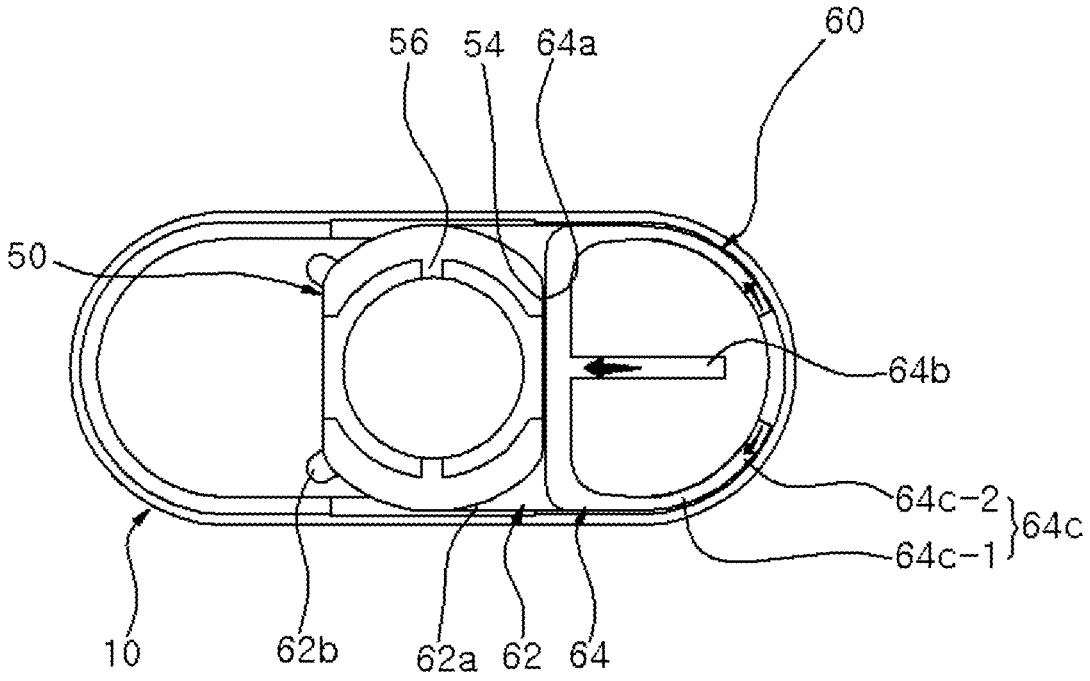
FIG. 7 is a plan view illustrating a state in which the protective tube is rotated by a certain angle relative to the body according to one embodiment of the present disclosure.

Thereafter, as shown in FIG. 6, when the protective tube 30 is continuously rotated with respect to the body 10, the cut surface 54 of the rotating member 50 faces the elastic wall 64*a* of the elastic member 60 at some point, and as shown in FIG. 7, the elastic rib 64*c* of the elastic member 60 is elastically restored to push the elastic wall 64*a* toward the rotating member 50, so that the elastic wall 64*a* of the elastic member 60 comes into close contact with the cut surface 54 of the rotating member 50. Accordingly, the rotation of the rotating member 50 is limited until the rotating member 50 is forcibly rotated to compress and deform the elastic member 60.

Through the above process, as shown in FIG. 8, the stick-type cosmetic content attached to the stick holder 40 is exposed to the outside through the inlet portion 32 of the protective tube 30, and the ascending or descending length of the stick holder 40 is always maintained uniformly.

The present disclosure has been described with reference to limited embodiments, drawings, and particular items such as specific components, it will be understood that the above description has been merely provided for further understanding the invention, and the present disclosure is not limited to the embodiments. It will be understood by those skilled in the art that various modifications and deformations may be carried out. Therefore, the spirit of the present disclosure will not be limited to the aforementioned embodiments, and the following claims as well as all modifications or variations belonging to the equivalents of the claims will be within the scope of the present disclosure.

| [Description of Reference Numerals] | |
|---|---|
| 10: Body | 12: Through-hole |
| 14: Guide portion | 16: Lower cap |
| 20: Operating member | 22: Bottom plate |
| 24: Operating portion | 26: Mounting portion |
| 30: Protective tube | 32: Inlet portion |
| 34: Insertion protruding portion | 40: Stick holder |
| 42: Coupling portion | 44: Plate portion |
| 50: Rotating member | 52: Fastening groove |
| 54: Cut surface | 60: Elastic member |

-continued

| [Description of Reference Numerals] | |
|---|---|
| 62: Fastening portion | 64: Elastic portion |
| 64a: Elastic wall | 64b: Guide rib |
| 64c: Elastic rib | 70: Overcap |

The invention claimed is:

1. A rotational angle-adjustable stick cosmetic container comprising:

a body;

an operating member coupled inside the body and having a lift protrusion formed therein;

a protective tube rotatably coupled to the body;

a stick holder moved up and down within the protective tube, having a stick cosmetic content at one side thereof, and having a lifting thread formed thereon;

a rotating member coupled to the body or the protective tube and rotated therewith about an axis; and an elastic member configured to provide the rotating member with elasticity, and including a fastening portion coupled to the rotating member, and an elastic portion elastically deformed while being pushed by the rotating member.

2. The rotational angle-adjustable stick cosmetic container of claim 1, wherein the rotating member includes a fastening groove to which the fastening portion of the elastic member is inserted and fitted, and a cut surface coming into close contact with one side of the elastic member to limit rotation of the rotating member.

3. The rotational angle-adjustable stick cosmetic container of claim 1, wherein the fastening portion of the elastic member is fitted horizontally while wrapping around an outer circumference of the rotating member, and the elastic portion is elastically deformed while coming into close contact with an inner wall of the body.

4. The rotational angle-adjustable stick cosmetic container of claim 1, wherein the elastic portion of the elastic member includes an elastic wall coming into contact with an outer circumference of the rotating member, a guide rib extending from the elastic wall and fitted and coupled to the body, and an elastic rib for elastically supporting the elastic wall.

5. The rotational angle-adjustable stick cosmetic container of claim 1, wherein the elastic member is provided as a pair and arranged symmetrically on both sides of the rotating member as a center.

* * * * *